US010253510B2

(12) United States Patent
Yang et al.

(10) Patent No.: US 10,253,510 B2
(45) Date of Patent: Apr. 9, 2019

(54) FLOOR NAILING GUN

(71) Applicant: TAIZHOU DAJIANG IND. CO., LTD., Wenling, Zhejiang (CN)

(72) Inventors: Ming-Jun Yang, Wenling (CN); Zai-Jun Zhu, Wenling (CN)

(73) Assignee: TAIZHOU DAJIANG IND. CO., LTD., Wenling, Zhejiang (CN)

( * ) Notice: Subject to any disclaimer, the term of this patent is extended or adjusted under 35 U.S.C. 154(b) by 461 days.

(21) Appl. No.: 15/092,080

(22) Filed: Apr. 6, 2016

(65) Prior Publication Data

US 2016/0222680 A1 Aug. 4, 2016

Related U.S. Application Data

(63) Continuation of application No. PCT/CN2013/087552, filed on Nov. 21, 2013.

(30) Foreign Application Priority Data

Nov. 12, 2013 (CN) ..... 2013 2 0713892 U

(51) Int. Cl.
*B25C 1/00* (2006.01)
*E04F 21/22* (2006.01)
(Continued)

(52) U.S. Cl.
CPC ..... *E04F 21/22* (2013.01); *B25C 1/005* (2013.01); *B25C 1/04* (2013.01); *B25C 3/00* (2013.01);
(Continued)

(58) Field of Classification Search
CPC ..... B25C 1/00; B25C 1/001; B25C 1/005; B25C 3/00; B25C 5/1606; B25C 5/1651;
(Continued)

(56) References Cited

U.S. PATENT DOCUMENTS 3,858,781 A * 1/1975 Obergfell ..... B25C 1/005 227/8
3,980,179 A * 9/1976 Schrepferman ..... B25C 1/005 206/338
(Continued)

FOREIGN PATENT DOCUMENTS

CN 201120599 Y 9/2008
CN 203236436 U 10/2013
JP H09272069 A 10/1997

OTHER PUBLICATIONS

State Intellectual Property Office of the P.R. China (ISR/CN), "International Search Report for PCT/CN2013/087552", China, dated Jan. 30, 2014.

*Primary Examiner* — Scott A Smith
(74) *Attorney, Agent, or Firm* — Tim Tingkang Xia, Esq.; Locke Lord LLP

(57) ABSTRACT

In one aspect of the invention, a floor nailing gun includes a nail magazine; a sleeve component; a nail ejecting component; an elastic component; and a base, where an end face of one end of the nail magazine is provided with at least one threaded hole for fixedly connecting the nail magazine to the base, and the sleeve component, the nail ejecting component, and the elastic component are mounted on the nail magazine, wherein the nail magazine is provided with an L-shaped groove having an L-shaped cross section or a T-shaped groove having a T-shaped cross section, and a boss for preventing nails from jumping up and down is formed at the top of the L-shaped groove or the T-shaped groove.

5 Claims, 3 Drawing Sheets

(51) Int. Cl.
*B25C 1/04* (2006.01)
*B25C 3/00* (2006.01)
*B25C 1/18* (2006.01)
*B25C 5/16* (2006.01)

(52) U.S. Cl.
CPC ..... *B25C 1/184* (2013.01); *B25C 5/1637* (2013.01); *B25C 5/1644* (2013.01); *B25C 5/1658* (2013.01)

(58) Field of Classification Search
CPC ..... B25C 5/1658; B25C 1/04; B25C 1/184; B25C 5/1637; B25C 5/1644
USPC ..... 227/120, 119, 109, 8, 136, 138, 123
See application file for complete search history.

(56) References Cited

U.S. PATENT DOCUMENTS 4,197,974 A * 4/1980 Morton ..... B25C 1/005 227/120
4,326,661 A * 4/1982 Maurer ..... B25C 1/005 206/338
4,463,888 A * 8/1984 Geist ..... B25C 1/005 227/109
4,815,647 A * 3/1989 Chou ..... B25C 1/005 227/109
5,335,800 A * 8/1994 Liu ..... B21J 15/32 221/198
5,579,975 A * 12/1996 Moorman ..... B25C 1/005 227/119
5,615,819 A * 4/1997 Hou ..... B25C 5/1651 227/109
5,632,431 A * 5/1997 Lin ..... B25C 1/005 227/109
5,641,110 A * 6/1997 Yang ..... B25C 1/005 227/109
5,971,688 A * 10/1999 Anstett ..... B25C 1/00 411/442
6,056,181 A * 5/2000 Chuang ..... B25C 1/005 227/120
6,443,348 B2 * 9/2002 Lamb ..... B25C 1/00 227/119
6,641,021 B2 * 11/2003 Jablonski ..... B25C 1/005 227/109
6,892,921 B2 * 5/2005 Beville ..... B25C 1/005 227/109
7,344,058 B2 * 3/2008 Bruins ..... B25C 5/1693 227/119
7,413,105 B1 * 8/2008 Ho ..... B25C 1/001 227/120
7,753,244 B2 * 7/2010 Nagata ..... B25C 1/184 227/120
7,815,087 B2 * 10/2010 Jian ..... B25C 1/005 227/119
7,971,768 B2 * 7/2011 Wywialowski ..... B25C 1/184 227/109
9,573,260 B2 * 2/2017 Walters, Jr. ..... B25C 1/005
9,713,867 B2 * 7/2017 Yang ..... B25C 1/005
2002/0060233 A1 * 5/2002 Akiba ..... B25C 1/005 227/109
2003/0201299 A1 * 10/2003 Chen ..... B25C 1/005 227/109
2007/0246502 A1 * 10/2007 Liu ..... B25C 5/161 227/120
2008/0067089 A1 * 3/2008 Zhu ..... B25C 5/1651 206/340
2008/0264999 A1 * 10/2008 Lee ..... B25C 5/1658 227/109
2008/0272168 A1 * 11/2008 Buetow ..... B25C 1/005 227/120

* cited by examiner

FLOOR NAILING GUN

CROSS-REFERENCE TO RELATED APPLICATIONS

This application is a continuation application of International Patent Application No. PCT/CN2013/087552, filed Nov. 21, 2013, which itself claims the priority to Chinese Patent Application No. 201320713892.0, filed Nov. 12, 2013 in the State Intellectual Property Office of P.R. China, which are hereby incorporated herein in their entireties by reference.

FIELD OF THE INVENTION

The present invention relates generally to tools, and more particularly, to a floor nailing gun.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art.

Floor nailing guns are necessary devices in decoration. Currently, most floor nailing guns on the market are for 16 Ga L-shaped flooring nails. During installation of some fragile and brittle flooring such as bamboo flooring, because nails are relatively large, the flooring can be easily damaged during installation. In addition, nail slots are designed to be larger than the nails, which mainly help load the nails and push the nails. However, the relatively large space of the nail slots may cause the nails to tremble in the nail slots, especially at a nail outlet of the floor nailing gun. When a striker strikes the nails, there is a very strict requirement on a location relationship; and the displacements and unevenness of the nails is unacceptable. Because the displacements and unevenness of the nails may cause faults such as jamming of the floor nailing gun or deviation of the nails, a lifetime of the floor nailing gun is reduced, the use effect and efficiency of the floor nailing gun are affected, and decorating effect is directly affected.

Therefore, heretofore unaddressed needs exist in the art to address the aforementioned deficiencies and inadequacies.

SUMMARY OF THE INVENTION

The present invention is directed to a floor nailing gun that has high nailing precision, prevents nails from trembling, and facilitates successful operation of nails.

In one aspect of invention, the floor nailing gun includes a nail magazine, a sleeve component, a nail ejecting component, an elastic component, and a base, where an end face of one end of the nail magazine is provided with a threaded hole for fixedly connecting the nail magazine to the base, which facilitates assembly, and the sleeve component, the nail ejecting component, and the elastic component are mounted on the nail magazine, where the nail magazine is provided with an L-shaped groove having an L-shaped cross section or a T-shaped groove having a T-shaped cross section, a boss for preventing nails from jumping up and down is disposed at the top of the L-shaped groove or the T-shaped groove, and the boss acts on the tails of the nails, prevents error positioning of the nails caused by manufacturing of a rounded corner, and prevents a user from loading nails that are not for this tool.

In one embodiment, one side of the L-shaped groove or the T-shaped groove of the nail magazine is provided with two notches, the two notches are opposite to each other and notch openings are aligned with each other, the nail ejecting component is inserted between the two notches and slides reciprocatingly by using the two notches as a rail, and an acting end of the nail ejecting component is located in the L-shaped groove or the T-shaped groove, which facilitates nail pushing.

In one embodiment, an end of the nail magazine is provided with two fixing holes for fixedly connecting the nail magazine to the base. When assembling, the two fixing holes are close to the base, one end of the elastic component is in hinged connection to the two fixing holes, and the other end of the elastic component is fixedly connected to the nail ejecting component.

In one embodiment, the elastic component includes a winding shaft and an elastic sheet wound around the winding shaft.

In one embodiment, the elastic sheet is a spring steel sheet.

In one embodiment, the other end of the nail magazine is provided with two mounting holes, and the sleeve component is fixedly connected to the two mounting holes.

As compared with the conventional floor nailing guns, the floor nailing gun according to the present invention has at least the following beneficial effect: a cross section of a nail magazine is simplified, so that costs are low, mass production is easy, and restrictions on operation of small nails are facilitated; a boss at an upper end of an L-shaped groove or a T-shaped groove in the cross section of the nail magazine can effectively prevent error positioning and prevent a user from loading nails that are not for this tool, and further, the boss can prevent nails from jumping up and down, so that smooth pushing and ejection of nails are ensured, and a phenomenon of jamming and deviation of nails may not occur; therefore, a service life of the floor nailing gun is prolonged, the use effect and efficiency of the floor nailing gun are improved, and decorating effect is directly improved.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

Figure 1:
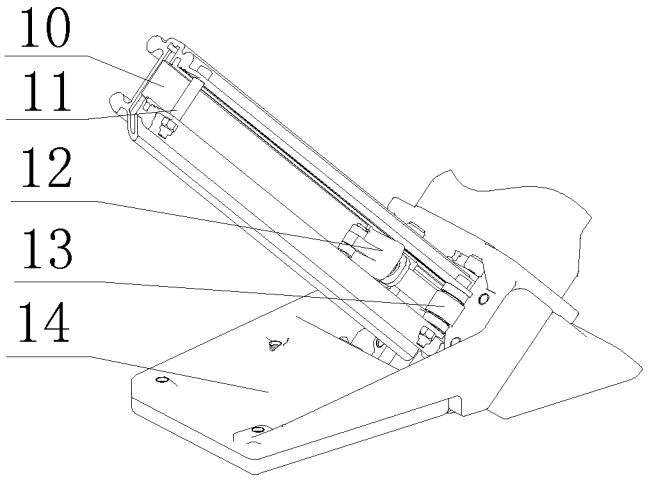
FIG. 1 shows schematically a floor nailing gun according to one embodiment of the present invention.
Figure 2:
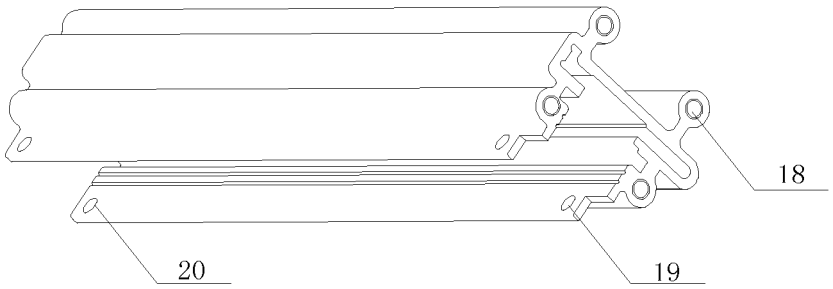
FIG. 2 shows schematically a nail magazine used in the floor nailing gun according to one embodiment of the present invention.
Figure 3:
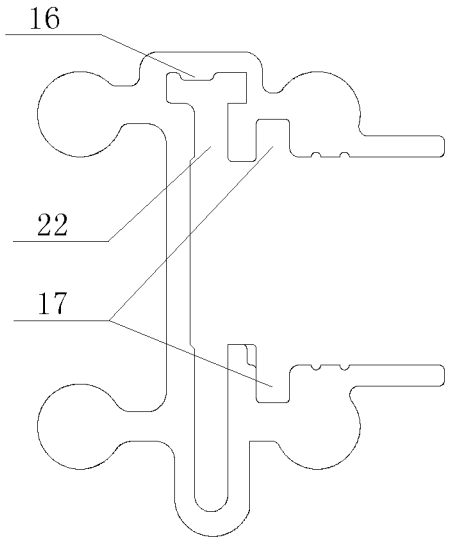
FIG. 3 shows schematically a nail magazine having a T-shaped cross section according to one embodiment of the present invention.
Figure 4:
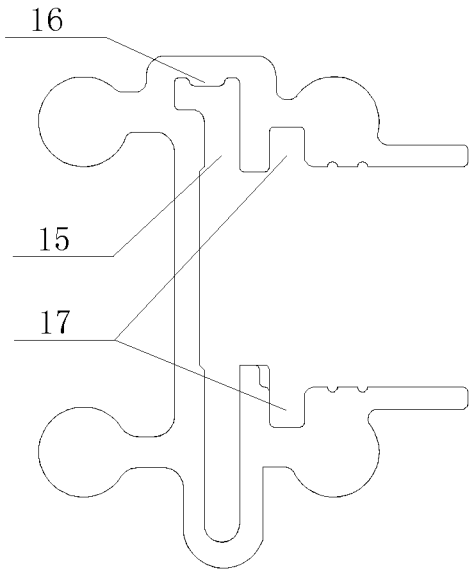
FIG. 4 shows schematically a nail magazine having an L-shaped cross section according to another embodiment of the present invention.
Figure 5:
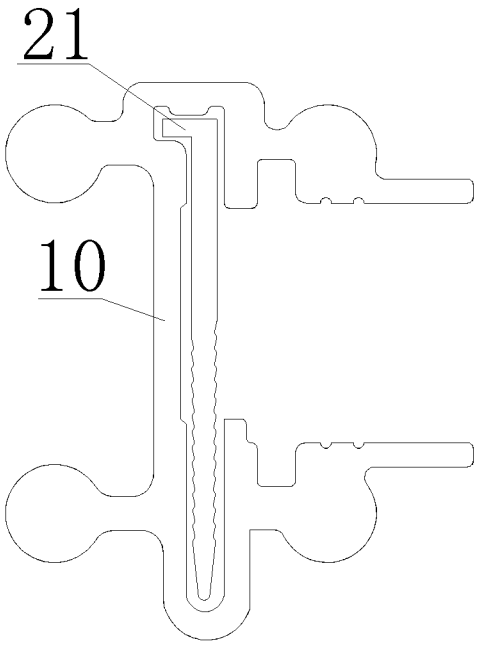
FIG. 5 shows schematically a cross-sectional view of a nail magazine having nails loaded to according to one embodiment of the present invention.

Listing of reference numerals: 10—Nail magazine, 11—Sleeve component, 12—Nail ejecting component, 13—Elastic component, 14—Base, 15—L-shaped groove, 16—Boss, 17—Notch, 18—Threaded hole, 19—Fixing hole, 20—Mounting hole, 21—Nail, and 22—T-shaped groove.

DETAILED DESCRIPTION OF THE INVENTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present invention in conjunction with the accompanying drawings. In accordance with the purposes of this invention, as embodied and broadly described herein, this invention, in one aspect, relates to a floor nailing gun.

Referring to FIGS. 1-6, a floor nailing gun includes a nail magazine 10, a sleeve component 11, a nail ejecting component 12, an elastic component 13, and a base 14. A end face of one end of the nail magazine 10 is provided with a threaded hole 18 for securely connecting the nail magazine 10 to the base 14. As assembled, the nail magazine 10 is securely connected to the base 14. The sleeve component 11, the nail ejecting component 12, and the elastic component 13 are mounted on the nail magazine 10. The nail magazine 10 is provided with an L-shaped groove (or L-shaped nail track) 15 having an L-shaped cross section or a T-shaped groove (or T-shaped nail track) 22 having a T-shaped cross section. A boss (or protrusion) 16 for preventing nails from jumping up and down is formed at the top of the L-shaped groove 15 or the T-shaped groove 22. The boss 16 acts on the tails of the nails 21, so as to prevent error positioning of the nails 21 caused by manufacturing of a rounded corner, and prevent a user from loading the nails that are not for this tool.

In the exemplary embodiment of the floor nailing gun described above, one side of the L-shaped groove 15 or the T-shaped groove 22 of the nail magazine 10 is provided with two notches 17. The two notches 17 are opposite to each other and notch openings are aligned with each other. The nail ejecting component 12 is inserted between the two notches 17, and slides reciprocatingly by using the two notches as a rail, and an acting end of the nail ejecting component 12 is located in the L-shaped groove 15 or the T-shaped groove 22, which facilitates nail pushing.

In the floor nailing gun, an end of the nail magazine 10 is provided with two fixing holes 19 for fixedly connecting the nail magazine 10 to the base 14. When assembling, the two fixing holes 19 are close to the base 14, one end of the elastic component 13 is in hinged connection to the two fixing holes 19, and the other end of the elastic component 13 is fixedly connected to the nail ejecting component 12.

In some embodiment, the elastic component 13 includes a winding shaft and an elastic sheet wound around the winding shaft. In some embodiment, the elastic sheet is a spring steel sheet.

In some embodiment, the other end of the nail magazine 10 is provided with two mounting holes 20, and the sleeve component 11 is fixedly connected to the two mounting holes 20.

Figure 6:
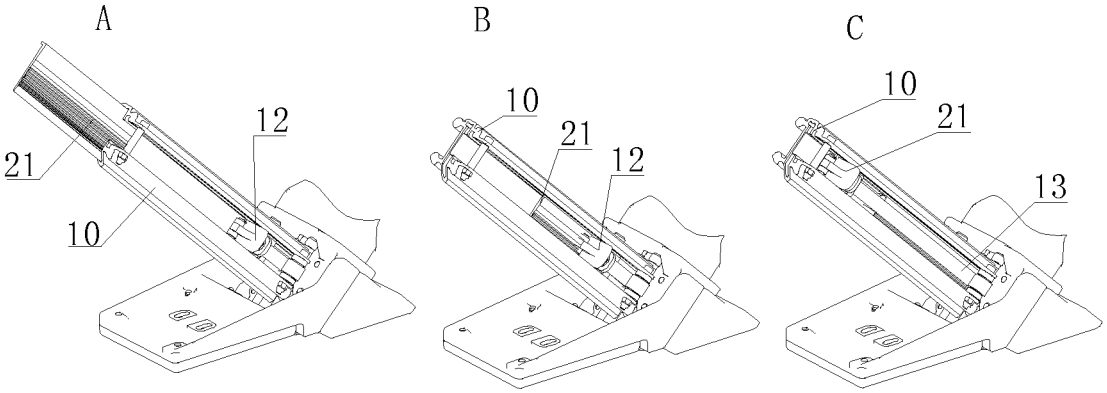
FIG. 6 shows schematically a nail loading process according to one embodiment of the present invention.

FIG. 6 shows schematically a nail loading process according to one embodiment of the present invention. As shown in A (FIG. 6A), the nails are loaded to the nail magazine 10 from the left and are pushed to the lower right side. As shown in B (FIG. 6B), the nail ejecting component 12 is pulled until the upper left end is blocked by the sleeve component 11. As shown in C (FIG. 6C), after the nail ejecting component 12 is released, the nail ejecting component 12 pushes, by means of resilience of the spring steel sheet on the elastic component 13, the nails 21 to move, the boss 16 at the upper end of the L-shaped groove 15 of the nail magazine 10 can effectively prevent error positioning and prevent a user from loading nails that are not for this tool, and furthermore. The boss 16 can also prevent the nails 21 from jumping up and down, so that smooth pushing and ejection of the nails are ensured, and a phenomenon of jamming and deviation of nails may not occur. Therefore, a service life of the floor nailing gun can be prolonged, the use effect and efficiency of the floor nailing gun are improved, and decorating effect is directly improved.

The foregoing description of the exemplary embodiments of the invention has been presented only for the purposes of illustration and description and is not intended to be exhaustive or to limit the invention to the precise forms disclosed. Many modifications and variations are possible in light of the above teaching. Therefore, any equivalent changes made according to the shape, structure, and principle of the present invention shall fall within the protection scope of the present invention.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A floor nailing gun, comprising:

a nail magazine;

a sleeve component;

a nail ejecting component;

an elastic component; and a base, wherein the nail magazine is fixedly connected to the base through at least one threaded hole formed at one end of the nail magazine, and wherein the sleeve component, the nail ejecting component, and the elastic component are mounted on the nail magazine, wherein the nail magazine includes an L-shaped groove having an L-shaped cross section or a T-shaped groove having a T-shaped cross section, and a boss formed at a top of the L-shaped groove or the T-shaped groove for operably preventing nails from moving up or moving down, wherein the nail magazine further includes two fixing holes formed close to the one end of the nail magazine, as assembled, the two fixing holes are close to the base, one end of the elastic component is in hinged connection to the nail magazine through the two fixing holes of the nail magazine, and another end of the elastic component is fixedly connected to the nail ejecting component.

2. The floor nailing gun according to claim 1, wherein one side of the L-shaped groove or the T-shaped groove of the nail magazine is provided with two notches, the two notches are opposite to each other and notch openings are aligned with each other, the nail ejecting component is inserted between the two notches, and slides reciprocatingly by using the two notches as a rail.

3. The floor nailing gun according to claim 1, wherein the elastic component comprises a winding shaft and an elastic sheet wound around the winding shaft.

4. The floor nailing gun according to claim 3, wherein the elastic sheet is a spring steel sheet.

5. The floor nailing gun according to claim 1, wherein the nail magazine further includes two mounting holes formed at another end of the nail magazine, and the sleeve component is fixedly connected to the nail magazine through the two mounting holes of the nail magazine.

* * * * *